US005779215A

United States Patent [19]

DeMasi

[11] Patent Number: 5,779,215

[45] Date of Patent: Jul. 14, 1998

[54] CHRISTMAS TREE STAND

[76] Inventor: Douglas D. DeMasi, 675 Beekman Rd., Hopewell Junction, N.Y. 12533

[21] Appl. No.: 599,805

[22] Filed: Feb. 12, 1996

[51] Int. Cl.[6] ..... A47G 7/02

[52] U.S. Cl. ..... 248/523; 47/40.5

[58] Field of Search ..... 248/511, 519, 248/523, 314, 188.4; 47/40.5; 52/211, 221, 219, 213

[56] References Cited

U.S. PATENT DOCUMENTS

| | | | |
|---|---|---|---|
| 2,928,633 | 3/1960 | Holmes et al. | 47/40.5 |
| 2,994,498 | 8/1961 | Sager | 47/40.5 |
| 3,794,279 | 2/1974 | Kramer | 248/523 |
| 4,712,328 | 12/1987 | Gies | 47/40.5 |
| 4,850,137 | 7/1989 | Foster | 47/40.5 X |
| 5,086,583 | 2/1992 | Breen | 47/40.5 |
| 5,320,323 | 6/1994 | Clark | 47/40.5 |

*Primary Examiner*—Ramon O. Ramirez
*Assistant Examiner*—Long Dinh Phan
*Attorney, Agent, or Firm*—Joseph B. Taphorn

[57] ABSTRACT

A Christmas tree stand vertically mounts a cylindrical tube from the bottom of a water container and so that it extends from the top thereof. An inflatable cylindrical bladder is mounted lengthwise to the inside of the tube. The stand is mounted on the trunk of a horizontal tree by inserting its bladder thereon and then inflating the bladder to tightly engage the trunk and center on it. The tree is then uprighted. Leveling screws in the bottom of the stand permit compensating for unlevel room floors and crooked trunks. A container for water about the tube adds ballast and provides life sustaining liquid to the tree trunk through holes in the bottom of the cylinder and in an upwardly concave plate in the bottom of the cylinder supporting the trunk in spaced relation to the container floor.

10 Claims, 4 Drawing Sheets

CHRISTMAS TREE STAND

FIELD OF THE INVENTION

This invention relates to Christmas tree stands and the like, and more particularly to a tree stand that facilitates the easy installation of a Christmas tree in an upright position.

BACKGROUND OF THE INVENTION

Christmas trees are evergreen trees purchased before the great December holiday and set up in the homes of celebrators of the holiday. It is usually desired to set up the tree upright on a stand and so that its trunk is vertical. Achieving this is difficult and time consuming.

PRIOR ART

Stands for Christmas trees are of numerous designs. They include those of the U.S. patents to Holmes et al (2,928,633); Sager (2,994,498); Kramer (3,794,279); Gies (4,712,328) Foster (4,850,137); and Breen (5,086,583) Holmes et al show a water tight container base 10, 11, centrally mounting a rigid cylindrical sleeve 25 a) constricted at its upper end 31, 32 about the tree by heating and b) inserted into the base with the tree thereafter. Sager shows a water container base 2 centrally mounting an upwardly projecting spike 5 and a rigid guide tube 3 terminating at its upper end with a ring 6 mounting three conventional centering screws 7. Kramer shows a water-fillable, hollow, collapsible container base 10 having a central, collapsible, cylindrical sleeve 20 which can be clamped to a an umbrella pole or the like by means of a split annular collar 32. Gies shows a casing base 1 housing three vertical clamping cylinders disposed about an open center toward which they are movable along inwardly curved surfaces by a rotatable cover connected to them and having a tree trunk receiving central opening. Foster shows, in a watering and dewatering arrangement, a water holding container 100 having at its top a cylinder providing a tree-trunk receiving central opening and mounting a ring holding three conventional centering screws. Breen shows an inverted trunk-receiving cone 20 in a water filled base 10; a tree trunk is held in the cone by a closed cell foam ring 32 introduced about the tree trunk in the cone.

SUMMARY OF THE INVENTION

Accordingly it is an object of the invention to provide a tree stand for easily mounting a Christmas tree in upright fashion.

A more specific object of the invention is to provide simple way for mounting a Christmas tree in upright fashion.

A further object of the invention is to provide a tree stand which allows also the bottom of the tree trunk to be situated in life sustaining water.

Another object of the invention is to provide a tree stand wherein the life sustaining water can be utilized as part of a stabilizing base.

According to the invention, a tree stand is provided with an inflatable bladder. The invention, inter alia, eliminates the need for trunk adjusting screws at one or both ends of a tree stand.

The invention utilizes an inflatable bladder inside a rigid column whose lower end terminates in a closed water tank constituting the base of the tree stand.

The bottom of the ridid column is concave and apertured to permit the inflow of water from the tank to the tree trunk bottom and absorption thereby.

The tree stand is placed on the tree trunk while the tree is lying on its side and the trunk is easily accessble. The inflatable column is moved onto the end of the trunk until a concavity at its bottom engages the bottom end of the tree trunk. The bladder is then inflated, the bladder centering the stand on the tree trunk, and vice versa. Thereafter the tree and stand are righted, water poured into the tank through a filling opening, and a stopper placed in the opening.

A feature of the invention is that should the tree thereafter be knocked over, the floor will not be wet as the inflatable bladder tightly engages the tree trunk to prevent the escape of liquids, while the stopper plugs the filler opening. This feature also facilitates the disposal of the tree without wetting the floor, because the tree can be carried tilted outside and the stand there removed for use at the next Christmas holiday.

Bolts on the bottom of the tank accommodate levelling for uneven floors and adjustment for crooked tree trunks.

BRIEF DESCRIPTION OF DRAWINGS OF A PREFERRED EMBODIMENT

These and other objects, features and advantages of the invention will become apparent from a reading of the following description of a preferred embodiment of the invention, when considered with the appended drawings wherein:

FIG. 1. is a diagrammatic view in perspective of a water-fillable tree stand having an inflatable bladder according to the invention;

FIG 2. is a vertical cross-sectional diagrammatic view of the tree stand of FIG. 1 with its inflatable bladder empty;

FIG. 3. is the same vertical cross-sectional diagrammatic view as FIG. 2, but with a tree trunk inserted and the inflatable bladder filled to engage the tree trunk tightly;

FIG. 4. is a diagrammatic view in perspctive of the inflatable bladder per se:

FIG. 5. is an elevational diagrammatic view of a plug for closing the filling opening in the tree stand; and FIG. 6. is an elevational diagrammatic view of a leveling screw for the tree stand.

DETAILED DESCRIPTION OF A PREFERRED EMBODIMENT OF THE INVENTION

Figure 1:
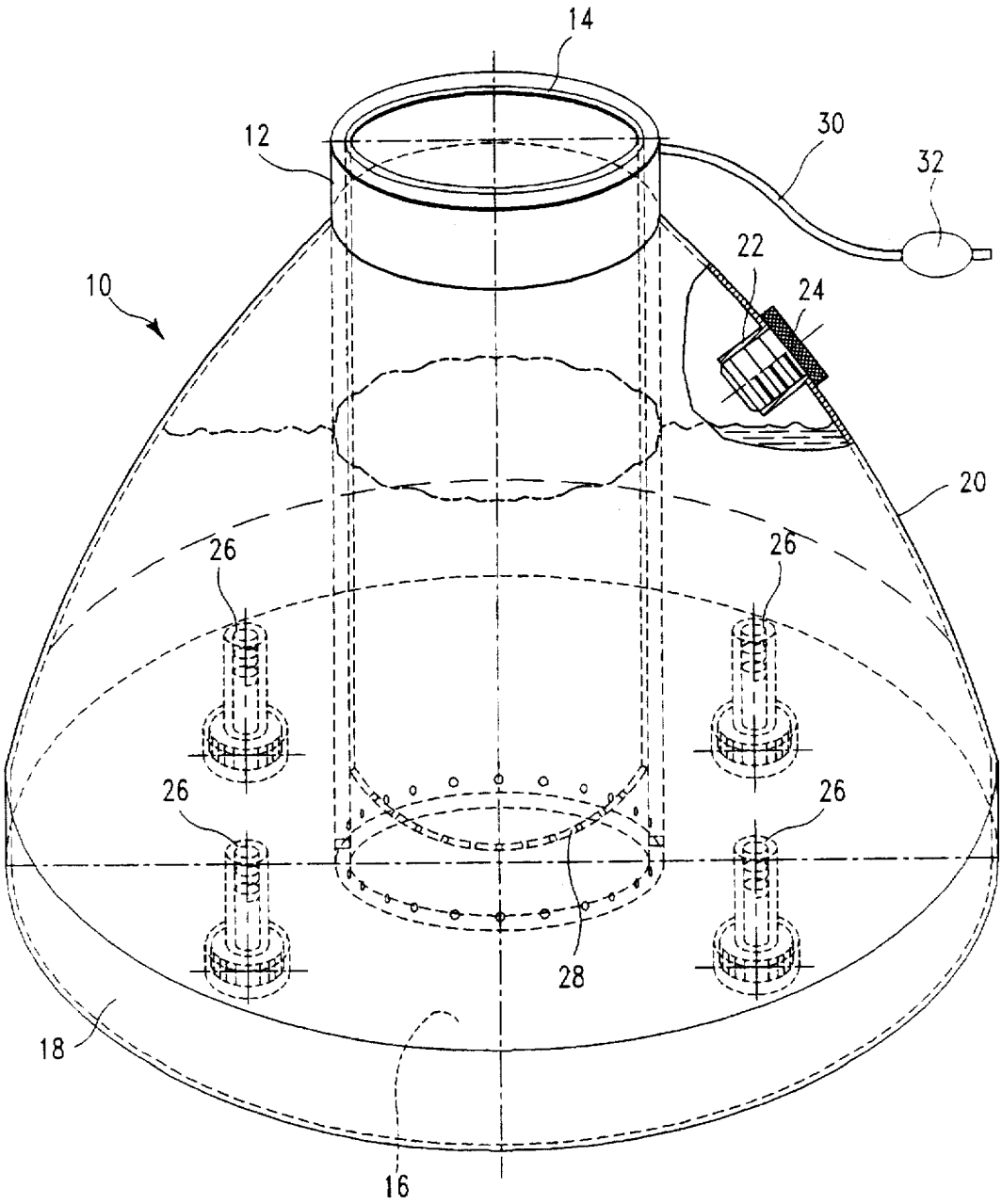
Figure 2:
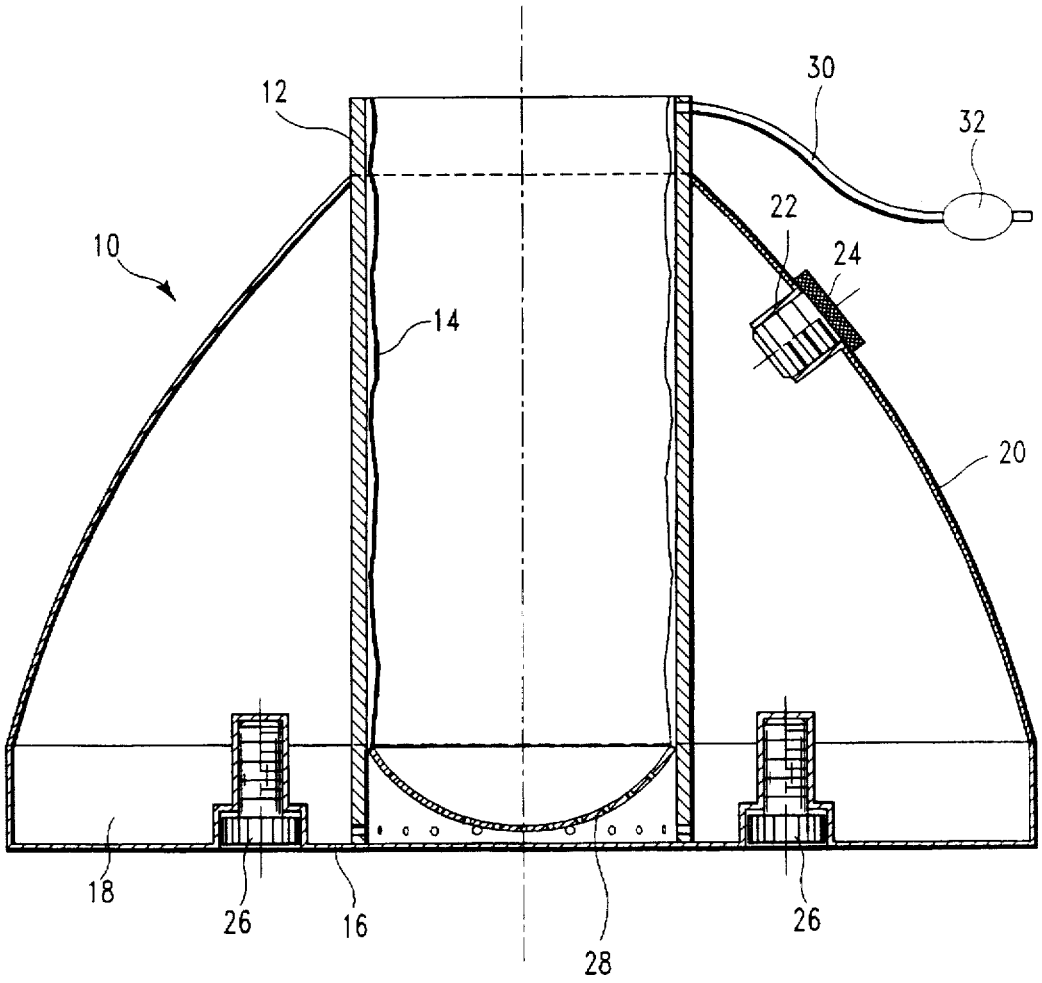

Referring now more particularly to the drawings, there is shown therein a tree stand formed of a somewhat conical container generally indicated by the numeral 10, a rigid cylinder 12 centrally located in the container and extending upward from the container upper end, and an inflatable bladder 14 secured about the inner surface of the cylinder. The container 10 includes a floor 16, a cylindrical portion wall portion 18 extending a short way up from the floor, and a (curved ) frusto-concical wall portion 20 extending up from the cylindrical wall portion 18 and terminating in an opening embracing the cylinder 12 near its upper end. The portion 20 has an opening 22 for filling the container 10 and that is closed by a screw plug 24.

The floor 16 of the container is recessed at four points to receive screws 26 for leveling the container on uneven floors and for righting the tree in the case of crooked tree trunks The cylinder 12 is secured as by welding at its bottom end to the floor 16 and at its upper end to the encircling upper end of the container wall portion 20. The bottom end of the cylinder is formed with a concave stop 28 on which the bottom end of an inserted tree trunk rest. The stop 28 is perforated to admit water to the bottom of the tree for keeping it alive. The bottom of the cylinder 12 is perforated to admit water from the container to the space beneath the bottom of the concave stop 28.

The bladder 14 (FIGS. 1–4), generally cylindrical and open at both ends is made of a strong, durable, air-impermeable material such as the plastic polyvinal chloride or rubber It is secured on its outside wall as with glue, to the inside wall of the cylinder 12. It is connected by a hose 30 to a suitable air pump and air release 32.

Figure 3:
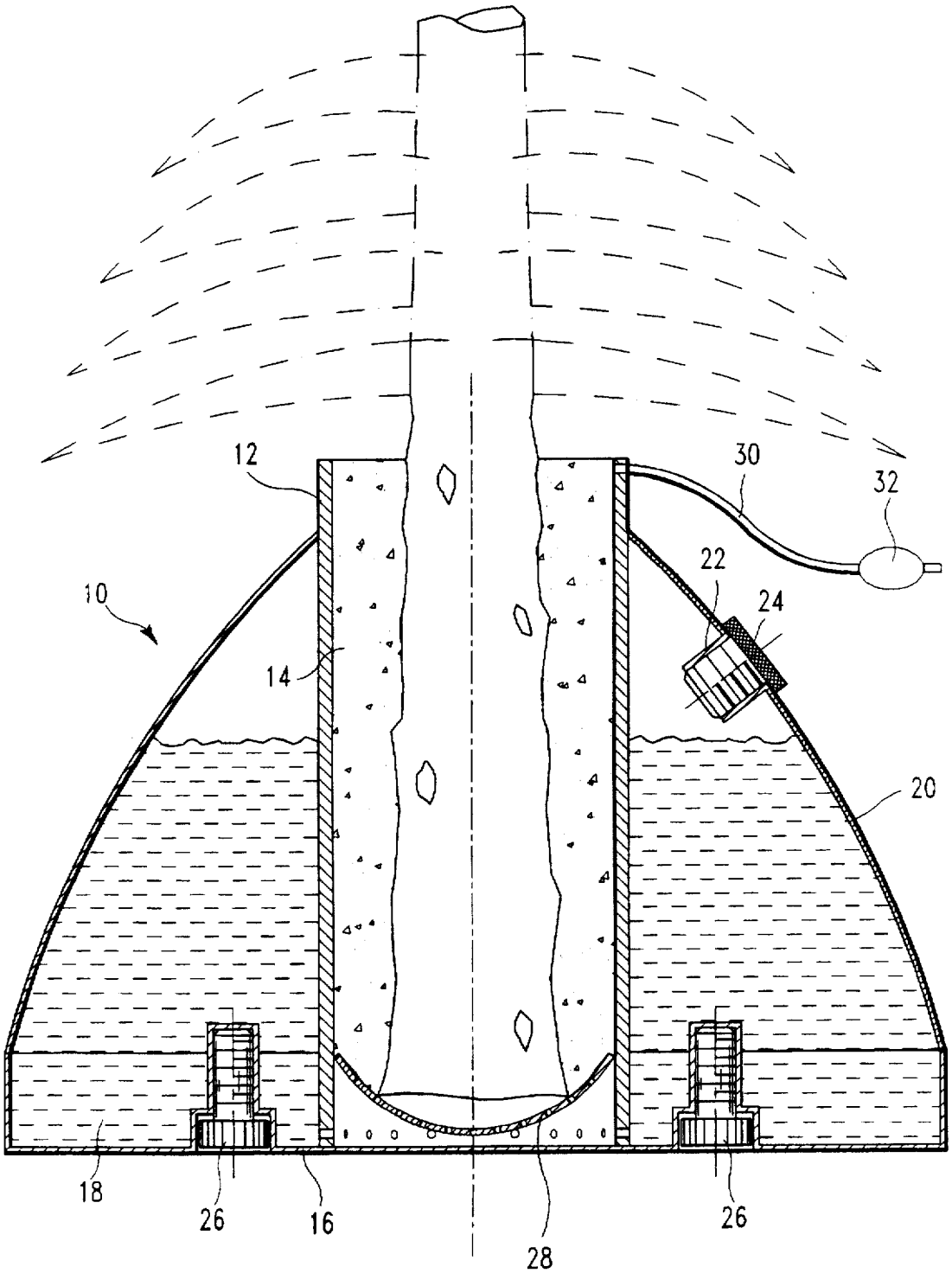
Figure 4:
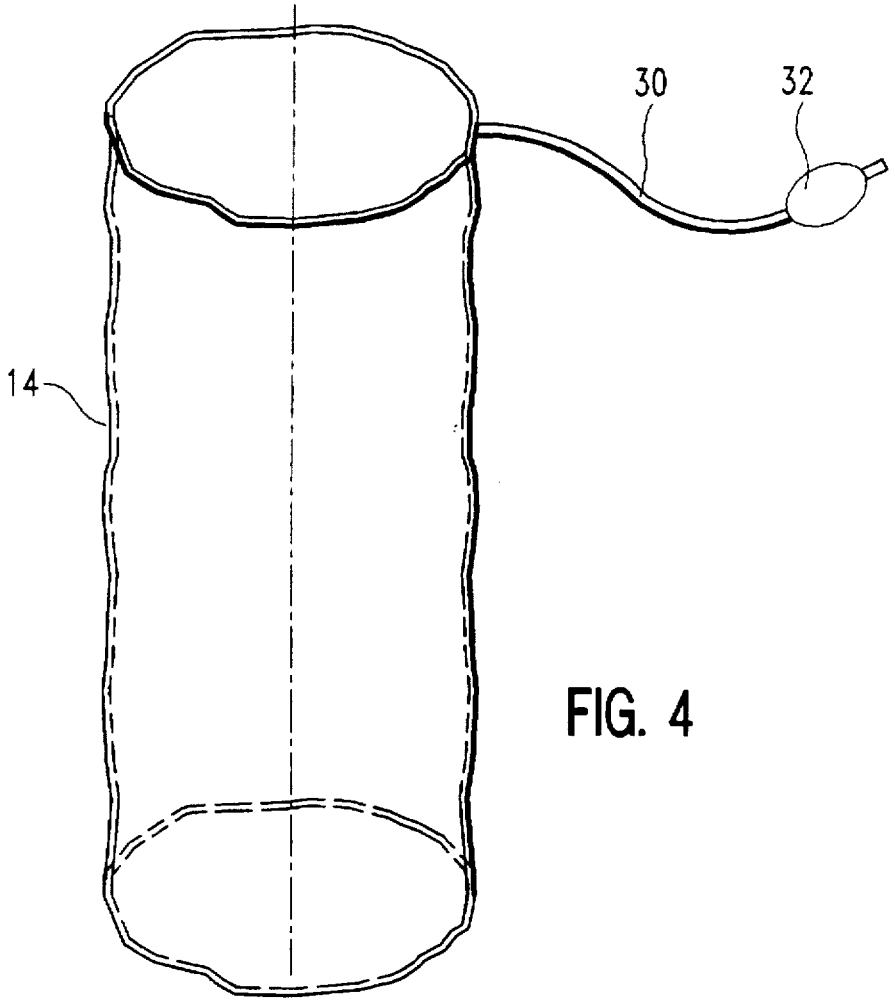
Figure 5:
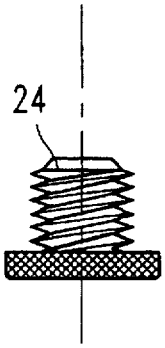
Figure 6:
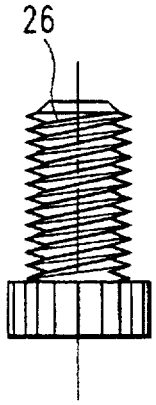

The bladder 14 is shown in its inflated condition in FIG. 3. The stand was inserted on the tree trunk with the bladder uninflated as in FIG. 2. After the stand was pushed on the tree trunk until the trunk's lower end struck the stop 28 at the bottom of the cylinder 12, the air pump 32 was actuated to inflate the bladder to the condition shown in FIG. 3. The stand is now secured to the tree and centered about the tree trunk.

The tree and tree stand would now be righted, and the floor 16 of the tree stand set on the room floor. The tree should now stand straight up, being centered in the inflated bladder 14. Should the room floor be uneven, the leveling screws 26 would be adjusted to suit. Should the tree have a crooked trunk, the screws would be adjusted to suit.

Water may now be added to the container 10 after removing the plug 24 from the opening 22, to provide extra stability to the Christmas tree and its stand, and to provide life giving moisture to the bottom of the tree trunk throught the perforations in the bottom of the cylinder 12 and the stop 28. Refilling would be done as desirable.

When it is desired to discard the tree, the tree and stand may be picked up and carried out sideways without fear of leakage of water. Once outside, the release 32 my be operated to allow the air to escape the bladder 14. The plug 24 may be removed from the opening 22 to drain the container before or after releasing the air from the bladder, as best suits the convenience of the disassembler.

While there has been shown and described a preferred embodiment of the invention, it will be apparent to those skilled in the art that other and different applications may be made of the principles of the invention. It is desired therefore to be limited only by the scope or spirit of the following claims

What is claimed is:

1. A Christmas tree stand comprising:

a framework adapted to be support on a floor;

a rigid tube centrally secured to said framework and extended vertically upwards for providing stable support to a tree in an upright fashion; and an inflatable bladder mounted on an inside wall of said tube for centering a tree trunk on said stand.

2. A Christmas tree stand comprising:

a generally conical water container having a floor and side walls tapering upwards to a first opening;

a rigid tube centrally secured to said floor of said container and extended vertically upwards through said first opening and being secured to an outside wall thereat for providing stable support to a tree in an upright fashion; and an inflatable bladder mounted on an inside wall of said tube for centering a tree trunk on the stand.

3. The Christmas tree stand according to claim 2, wherein said bladder extended lengthwise and formed in a cylindrical shape.

4. The Christmas tree stand according to claim 2, wherein said tube has a liquid communication hole on a bottom wall for allowing water to be evenly distributed between said container and said tube.

5. The Christmas tree stand according to claim 4, further comprising a stop at a bottom of said tube for holding a bottom of any inserted tree trunk in spaced relation to the bottom of said tube.

6. The Christmas tree stand according to claim 5, wherein said stop is an upwardly concave plate that is perforated to allow passage of water.

7. The Christmas tree stand according to claim 2, wherein said container further comprising a second opening on an upper side wall of said container for adding and draining water.

8. The Christmas tree stand according to claim 7, further comprising a plug for closing and opening said container second opening.

9. The Christmas tree stand according to claim 2 wherein said bladder is connected by a hose to a suitable air pump and release.

10. A method of erecting upright a Christmas tree, comprising the steps of:

providing a tree stand including a generally water container having a floor and side walls tapering upwards to an opening, a rigid tube centrally secured to said floor of said container and extended vertically upwards through said opening and being secured to an outside wall thereat, and an inflatable bladder mounted on an inside wall of said tube;

placing a tree centrally on an inside of said stand; and inflating said bladder to engage the tree trunk-and raising the tree to rest on the stand.

* * * * *